US006652172B2

(12) United States Patent
Wood et al.

(10) Patent No.: US 6,652,172 B2
(45) Date of Patent: Nov. 25, 2003

(54) METHOD AND APPARATUS FOR HANDLING LINERLESS LABEL TAPE WITHIN A PRINTING DEVICE

(75) Inventors: Thomas L. Wood, Hudson, WI (US); Lloyd S. Vasilakes, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 39 days.

(21) Appl. No.: 09/754,971

(22) Filed: Jan. 5, 2001

(65) Prior Publication Data

US 2002/0090244 A1 Jul. 11, 2002

(51) Int. Cl.[7] ..... B41J 11/70
(52) U.S. Cl. ..... 400/621; 400/621.2
(58) Field of Search ..... 400/621, 616.3, 400/613, 621.1, 621.2

(56) References Cited

U.S. PATENT DOCUMENTS

| | | | |
|---|---|---|---|
| 2,492,908 | A | 12/1949 | Von Hofe |
| 2,788,625 | A | 4/1957 | Larsen et al. |
| 2,990,081 | A | 6/1961 | De Neui et al. |
| 3,561,190 | A | 2/1971 | Derenthal |
| 3,657,051 | A | 4/1972 | McCarthy |
| 3,905,859 | A | 9/1975 | Patterson |
| 3,963,557 | A | 6/1976 | Patterson |
| 4,001,072 | A | 1/1977 | deNeui |
| 4,072,224 | A | 2/1978 | Barnaby et al. |
| 4,161,138 | A | 7/1979 | Marchetti |

(List continued on next page.)

FOREIGN PATENT DOCUMENTS

| | | | |
|---|---|---|---|
| CH | 687 193 | A5 | 10/1996 |
| DE | 32 34 556 | A1 | 5/1984 |
| DE | 37 27 667 | A1 | 3/1989 |

(List continued on next page.)

OTHER PUBLICATIONS

US 4,909,885, 3/1990, Swenson (withdrawn)
N. Draper & H. Smith, *Applied Regression Analysis*, 2nd Ed., Chapters 2 and 6 (1966).
*Research Disclosure*, Nov. 1994, No. 367.
3M Innovative Properties Co., "3M–Matic™ Corner Label Applicator CA2000" Brochure, © 1999.

*Primary Examiner*—Andrew H. Hirschfeld
*Assistant Examiner*—Anthony H. Nguyen
(74) *Attorney, Agent, or Firm*—James D. Christoff

(57) ABSTRACT

An apparatus for printing on a continuous web of linerless tape defined by a print side for subsequent application to an article. The apparatus includes a support, a rotatably driven platen roller, a print head, and a stripping apparatus. The support is configured to maintain a continuous web of linerless tape. The rotatably driven platen roller is located downstream of the support. The print head is associated with the platen roller. More particularly, the platen roller directs the continuous web of linerless tape past the print head for printing on the print side thereof. Finally, the stripping apparatus is positioned adjacent the platen roller and downstream of the print head for directing the web of linerless material from the platen roller. In this regard, the stripping apparatus includes a first roller and a second roller. The first roller is positioned to receive and contact the print side of the linerless tape. Conversely, the second roller is positioned to receive and contact the adhesive side of the linerless tape. The first and second rollers form a nip for engaging the linerless tape and operate in tandem to strip the linerless tape from the platen roller during use thereof. In one preferred embodiment, the second roller is configured to minimize adhesion with the adhesive side of the tape, and is rotated at a speed greater than that of the platen roller so as to impart a tension on the web of linerless tape. In another preferred embodiment, a hot ribbon wire cutter is provided to sever a label segment from a remainder of the web.

1 Claim, 3 Drawing Sheets

U.S. PATENT DOCUMENTS

| | | | | |
|---|---|---|---|---|
| 4,200,483 | A | | 4/1980 | Hoveler |
| 4,227,955 | A | | 10/1980 | Woods et al. |
| 4,256,528 | A | | 3/1981 | Patterson |
| 4,321,103 | A | | 3/1982 | Lindstrom et al. |
| 4,334,448 | A | * | 6/1982 | Messerschmitt ..... 83/171 |
| 4,388,143 | A | | 6/1983 | Buchholz et al. |
| 4,389,009 | A | | 6/1983 | Yamashita |
| 4,421,817 | A | | 12/1983 | Pina et al. |
| 4,427,144 | A | | 1/1984 | Macgrory et al. ..... 225/7 |
| 4,432,830 | A | | 2/1984 | Jue |
| 4,577,199 | A | | 3/1986 | Saiki et al. |
| 4,676,859 | A | | 6/1987 | Cleary, Jr. et al. |
| 4,707,211 | A | | 11/1987 | Shibata |
| 4,784,714 | A | | 11/1988 | Shibata |
| 4,807,177 | A | | 2/1989 | Ward |
| 4,815,871 | A | | 3/1989 | McGourty et al. |
| 4,889,581 | A | | 12/1989 | Ulrich et al. |
| 5,037,219 | A | | 8/1991 | Duport |
| 5,040,461 | A | | 8/1991 | Van-Ocker |
| 5,121,586 | A | | 6/1992 | Focke |
| 5,168,814 | A | | 12/1992 | Kuzuya et al. |
| 5,193,926 | A | | 3/1993 | Kuzuya et al. |
| 5,209,808 | A | | 5/1993 | Booth |
| 5,227,002 | A | | 7/1993 | Faust et al. |
| 5,261,996 | A | | 11/1993 | Rossini |
| 5,286,332 | A | | 2/1994 | Rossini ..... 156/527 |
| 5,292,713 | A | | 3/1994 | Stenzel et al. ..... 503/226 |
| 5,295,753 | A | | 3/1994 | Godo et al. |
| 5,302,034 | A | | 4/1994 | Kitazawa |
| 5,308,173 | A | | 5/1994 | Amano et al. |
| 5,354,588 | A | | 10/1994 | Mitchell et al. |
| 5,376,418 | A | | 12/1994 | Rogers et al. |
| 5,379,962 | A | | 1/1995 | Albrecht et al. ..... 242/527.7 |
| 5,399,036 | A | | 3/1995 | Yamaguchi |
| 5,419,648 | A | | 5/1995 | Nagao et al. |
| 5,425,823 | A | | 6/1995 | Woodside, III |
| 5,431,763 | A | | 7/1995 | Bradshaw |
| 5,437,228 | A | | 8/1995 | Uland |
| 5,443,318 | A | | 8/1995 | Kitazawa |
| 5,482,593 | A | | 1/1996 | Kuhn et al. |
| 5,487,337 | A | | 1/1996 | Uland ..... 101/288 |
| 5,494,360 | A | | 2/1996 | Watanabe et al. |
| 5,497,701 | A | | 3/1996 | Uland ..... 101/288 |
| 5,503,485 | A | | 4/1996 | Nakazato |
| 5,524,996 | A | | 6/1996 | Carpenter et al. ..... 400/621 |
| 5,531,853 | A | | 7/1996 | Cubow et al. |
| 5,540,369 | A | | 7/1996 | Boreali et al. |
| 5,549,783 | A | | 8/1996 | Schroeder et al. |
| 5,560,293 | A | | 10/1996 | Boreali et al. ..... 101/288 |
| 5,569,515 | A | | 10/1996 | Rice, II et al. |
| 5,614,928 | A | | 3/1997 | Matsuda |
| 5,658,647 | A | | 8/1997 | Magill et al. |
| 5,661,099 | A | | 8/1997 | Mitchell, Jr. ..... 503/201 |
| 5,674,345 | A | | 10/1997 | Nash |
| 5,674,626 | A | | 10/1997 | Khatib et al. |
| 5,675,369 | A | | 10/1997 | Gaskill |
| 5,782,496 | A | | 7/1998 | Casper et al. |
| 5,832,827 | A | | 11/1998 | Pistro et al. ..... 101/288 |
| 5,857,789 | A | | 1/1999 | Day et al. |
| 5,879,507 | A | | 3/1999 | Schroeder et al. |
| 5,940,107 | A | | 8/1999 | Fox |
| 5,997,193 | A | | 12/1999 | Petterutti et al. ..... 400/88 |
| 6,007,263 | A | | 12/1999 | Imai et al. |
| 6,049,347 | A | | 4/2000 | Ewert et al. ..... 347/215 |
| 6,067,103 | A | | 5/2000 | Ewert ..... 347/171 |

FOREIGN PATENT DOCUMENTS

| | | | |
|---|---|---|---|
| DE | 44 12 091 A1 | | 10/1995 |
| DE | 195 35 535 A1 | | 3/1997 |
| DE | 196 09 431 a1 | | 9/1997 |
| EP | 0 170 172 A1 | | 2/1986 |
| EP | 0 096 423 A1 | | 1/1994 |
| EP | 0 579 423 A1 | | 1/1994 |
| EP | 0 579 430 A1 | | 1/1994 |
| EP | 0 673 839 A1 | | 9/1995 |
| EP | 0 688 008 A1 | | 12/1995 |
| EP | 0 637 547 B1 | | 10/1996 |
| EP | 0 763 471 A1 | | 3/1997 |
| EP | 0 834 404 A2 | | 4/1998 |
| GB | 2 243 135 | | 10/1991 |
| GB | 2 325 453 | | 11/1998 |
| JP | 57-32990 | | 2/1982 |
| JP | 07159968 | * | 6/1995 |
| JP | 10-101043 | | 4/1998 |
| JP | 2000247508 | | 9/2000 |
| JP | 2001-98814 | | 4/2001 |
| WO | WO 95/31800 A1 | | 11/1995 |
| WO | WO 96/10489 | | 4/1996 |
| WO | WO 96/21557 A1 | | 7/1996 |
| WO | 96/26864 | | 9/1996 |
| WO | WO 96/40508 | | 12/1996 |
| WO | WO 97/05021 A1 | | 2/1997 |
| WO | WO 97/10148 | | 3/1997 |
| WO | 97/14616 | | 4/1997 |
| WO | 97/15501 | | 5/1997 |
| WO | WO 97/43744 A1 | | 11/1997 |
| WO | WO 97/46389 A1 | | 12/1997 |
| WO | 98/42578 | | 10/1998 |
| WO | WO 99/20468 A1 | | 4/1999 |
| WO | 99/54860 | | 10/1999 |
| WO | 99/61322 | | 12/1999 |
| WO | WO 00/34131 A1 | | 6/2000 |
| WO | WO 00/76853 A1 | | 12/2000 |
| WO | WO 01/74667 A1 | | 10/2001 |
| WO | WO 01/96184 A1 | | 12/2001 |

* cited by examiner

METHOD AND APPARATUS FOR HANDLING LINERLESS LABEL TAPE WITHIN A PRINTING DEVICE

THE FIELD OF THE INVENTION

The present invention relates to systems for handling linerless tape. More particularly, the present invention relates to a method and apparatus for handling and printing on thin, linerless label tape, such as with a linerless label printer.

BACKGROUND OF THE INVENTION

Containers, packages, cartons, and cases, (generally referred to as "boxes") for storing and shipping products typically use box sealing tape, such as an adhesive tape, to secure the flaps or covers so that the box will not accidentally open during normal shipment, handling, and storage. Box sealing tape maintains the integrity of a box throughout its entire distribution cycle. Box sealing tape can be used on other parts of boxes and on other substrates, and can be used to function in a manner similar to labels. These tapes can be made in roll or pad form, and can have information printed or otherwise applied to, or contained within or on, the tape.

These boxes generally display information about the contents. This information most commonly located on the box might include lot numbers, date codes, product identification information, and bar codes. The information can be placed onto the box using a number of methods. These include preprinting the box when it is manufactured, printing this information onto the box at the point of use with an inkjet code that sprays a pattern of ink dots to form the image, or by using a flexographic ink rolling coding system. Other approaches include the use of labels, typically white paper with preprinted information either applied manually, or with an online automatic label applicator.

A recent trend in conveying information related to the product is the requirement to have the information specific for each box. For example, each box can carry specific information about its contents and the final destination of the product, including lot numbers, serial numbers, and customer order numbers. The information is typically provided on labels that are customized and printed on demand at the point of application onto the box. This is typically known as the ability to print "variable" information onto a label before it is applied onto the box. Two patents that disclose printed labels are U.S. Pat. Nos. 5,292,713 and 5,661,099.

One system for printing variable information involves thermal transfer ink printing onto labels using an ink ribbon and a special heat transfer print head. A computer controls the print head by providing input to the head, which heats discrete locations on the ink ribbon. The ink ribbon directly contacts the label so that when a discrete area is heated, the ink melts and is transferred to the label. Another approach using this system is to use labels that change color when heat is applied (direct thermal labels). In another system, variable information is directly printed onto a box or label by an inkjet printer including a print head. A computer can control the ink pattern sprayed onto the box or label.

Both thermal transfer and inkjet systems produce sharp images. Inkjet systems include piezo, thermal, continuous, and drop-on-demand. With both inkjet and thermal transfer systems, the print quality depends on the surface on which the ink is applied. It appears that the best system for printing variable information is one in which the ink and the print substrate can be properly matched to produce a repeatable quality image, especially bar codes, that must be read by an electronic scanner with a high degree of reliability.

Regardless of the specific printing technique, the printing apparatus includes a handling system for guiding a continuous web of label tape (or "label tape") to the print head, as well as away from the print head following printing for subsequent placement on the article of interest (for example, a box). To this end, the web of label tape is normally provided in a rolled form ("tape supply roll"), such that the printing device includes a support that rotatably maintains the tape supply roll. Further, a series of guide components, such as rollers, transfer plates, festoons, etc., are utilized to establish a desired tape path both upstream and downstream of the print head, with the terms "upstream" and "downstream" in reference to a tape transport path initiating at the tape supply roll and terminating at the point label application to the article of interest (e.g., a box). An exact configuration of the guide components is directly related to the form of the label tape.

In particular, label tape is provided as either a linered tape or as a linerless tape. As suggested by its name, linered tape includes both a tape defined by a print side and an adhesive side, and a release liner encompassing the adhesive side. The liner serves as the carrier for the label tape. With this configuration, the printing device normally includes components that, in addition to delivering the web to and from the print head, also peel the liner away from the label tape. While widely accepted, linered tape material is relatively expensive due to the cost associated with inclusion of the release liner. Further, the liner adds to the overall thickness, thereby decreasing the available length of label tape for a given tape supply roll diameter. A decreased label tape length requires more frequent changeovers of the tape supply roll (where the exhausted tape supply roll is replaced by a new roll), and therefore a loss in productivity. Additionally, because the liner material is typically paper, resultant fibers, debris, and dust can contaminate the printing mechanism, potentially resulting in a reduced print head life. Also, a die cut operation is typically performed on the label stock to generate labels of discrete size. The die cut operation is an additional manufacturing step (and therefore expense), and prevents implementation of a variable label length processing approach.

To overcome the above-described problems associated with linered label tape, a linerless format has been developed. Generally speaking, linerless label tapes are similar to the linered configuration, except that the liner is no longer included. Thus, the linerless label tape is defined by a non-adhesive side formulated to receive printing ("print side") and an opposing side that carries an adhesive ("adhesive side"). By eliminating the liner, linerless label tapes have a greatly increased length for a given roll diameter, and eliminate many of the other above-listed processing concerns associated with linered label tape. However, certain other handling issues are presented.

As the web of linerless tape is pulled or extended from the supply roll, the adhesive side is exposed and will readily adhere to contacted surfaces, in particular the guide components associated with the printing device. A common difficulty encountered in the handling of linerless label tape is "wrap-around", whereby the web adheres to and wraps around a roller otherwise in contact with the adhesive side. For example, with thermal transfer printing, a platen roller is normally associated with the print head for supporting the label tape during printing by the print head. In this regard, the adhesive side of the linerless tape is in contact with, and carried by, the platen roller. Invariably, instead of simply releasing from the platen roller, the adhesive side adheres to and wraps around the platen roller. This highly undesirable situation leads to printer malfunctions, such as misprinting, tape jams, etc. Wrap-around of the platen roller is most commonly found in printing devices conforming with "next label segment out" protocol where, after the label is printed, it is immediately cut and applied to the article in question. In other words, there is no accumulation of printed labels between the print head and the application device. More importantly, unlike a "loose loop" system where printed labels accumulate prior to cutting and thus includes guide components, such as festoons, to tension the linerless label tape off of the platen roller, a "next label segment out" configuration has a very limited tape path length following printing along which a tension-supplying device(s) can be included.

Efforts have been made to address the "wrap-around" concern associated with linerless label tape in next label segment out printing systems, including those described in U.S. Pat. Nos. 5,674,345; 5,524,996; 5,487,337; 5,497,701; and 5,560,293. In summary, each of these references incorporates a device, such as a stripper bar, a stripper plate, or an air source, that interacts with the linerless label tape after it has undesirably adhered to the platen roller. That is to say, the common technique for addressing platen roller wrap-around is to position a device adjacent the platen roller that effectively "scrapes" the linerless label tape off of the platen roller in the event of platen roller wrap-around.

The above-described techniques for overcoming platen roller wrap-around rely upon the linerless label tape in question being relatively thick or rigid. In this regard, most available linerless label tapes have thicknesses in excess of about 100 microns (4 mils) and are paper-based. More recently, thin, plastic-based (e.g., polypropylene) linerless label tapes have become available. These types of linerless label tapes exhibit better dimensional stability with changes in humidity, and are less expensive than paper-based linerless tapes of a comparable quality. In addition, the plastic-based, linerless label tapes are comparatively thinner, thereby providing an increased web length on a roll of given diameter, and are generally less costly. As a point of reference, recently available linerless label tapes have a thickness of less than about 90 microns (3.5 mils), as thin as approximately 50 microns (2 mils). With this reduction in thickness, these new linerless label tapes are less rigid (or "flimsier") as compared to standard paper-based, or higher gauge plastic film-based, linerless label tapes. Due to the reduced rigidity, available techniques for removing the linerless label tape from the platen roller are not reliable. In fact, many current linerless label tape handling systems experience wrap-around when handling adhesive-coated polypropylene linerless label tapes having thicknesses of less than or equal to approximately 90 microns (3.5 mils).

An additional concern related to handling of linerless label tape is the tendency of the exposed, adhesive side to adhere to a mechanical cutting device during a label segment cutting operation following printing. The elevated adhesiveness of more recently available linerless label tapes greatly increases the possibility of imperfect mechanical cutting.

High volume label printing systems continue to evolve. Recent enhancements to label tapes, and in particular linerless label tapes, present handling concerns not satisfactorily resolved by existing designs. Therefore, a need exists for a method and apparatus for handling linerless label tapes within printing device, including elimination of platen roller wrap-around and mechanical cutting errors.

SUMMARY OF THE INVENTION

One aspect of the present invention relates to an apparatus for printing on a continuous web of linerless tape defined by a print side and an adhesive side for subsequent application to an article. The apparatus includes a support, a rotatably driven platen roller, a print head, and a stripping apparatus. The support is configured to maintain a continuous web of linerless tape. The rotatably driven platen roller is located downstream of the support. The print head is associated with the platen roller. More particularly, the platen roller directs the continuous web of linerless tape past the print head for printing on the print side thereof, and can be positioned to directly support the linerless tape during a printing operation. Finally, the stripping apparatus is positioned adjacent the platen roller and downstream of the print head for directing the web of linerless tape from the platen roller. In this regard, the stripping apparatus includes a first roller and a second roller. The first roller is positioned to receive and contact the print side of the linerless tape. Conversely, the second roller is positioned to receive and contact the adhesive side. The first and second rollers form a nip for engaging the linerless tape and operate to strip the linerless tape from the platen roller. In one preferred embodiment, the second roller is configured to minimize adhesion to the adhesive side of the tape, and, along with the first roller, is rotated at a speed greater than that of the platen roller so as to impart a tension on the web of linerless tape.

Another aspect of the present invention relates to a method of printing indicia on a continuous web of linerless tape with a printing device for subsequent application to an article, the printing device including a print head associated with a rotatably driven platen roller for subsequent application to an article. In this regard, the web of linerless tape is defined by a print side and an adhesive side. With this in mind, the method includes providing a stripping apparatus including first and second rollers forming a nip therebetween. The stripping apparatus is positioned adjacent the platen roller downstream of the print head. A continuous web of linerless tape having a thickness of less than about 90 microns is also provided. The web is extended along a tape path from the platen roller to the stripping apparatus such that the platen roller contacts the adhesive side, the first roller contacts the print side, and the second roller contacts the adhesive side. The platen roller is rotated to direct the web past the print head. The first and second rollers are rotated to strip the web from the platen roller. Finally, the print head is employed to print indicia on the print side of the linerless tape. In this regard, the first and second rollers direct the linerless tape from the platen roller. In one preferred embodiment, the first and second rollers are rotated at a surface speed greater than that of the platen roller so as to create a tension in the web of linerless tape. In another preferred embodiment, extending the web along a tape path includes establishing a wrap angle for the web of linerless tape of greater than 60° along the platen roller.

Yet another aspect of the present invention relates to a tape path for a continuous web of linerless tape within a printing device for subsequent application to an article. In this regard, the printing device includes a print head associated with a platen roller and a stripping apparatus positioned adjacent the platen roller downstream of the print head. With this in mind, the tape path comprises a wrap angle along the platen roller downstream from the print head of at least 60°. In one preferred embodiment, the stripping apparatus includes first and second rollers forming a nip, and the tape path further comprises a wrap angle along the first roller from the platen roller to the nip of at least 60°.

Yet another aspect of the present invention relates to a cutting device for use within a printing device to sever a label segment from a web of linerless tape defined by a print side and an adhesive side for subsequent application to an article. The cutting device includes a heated cutting element and a supply device for directing the web of linerless tape to the heated cutting element. In this regard, the heated cutting element is positioned relative to the supply device such that the heated cutting element initially contacts the print side of the web of linerless tape during a cutting operation. In one preferred embodiment, the heated cutting element is a ribbon wire having a height:width ratio greater than 25:1.

Yet another aspect of the present invention relates to a method of cutting a continuous web of linerless tape defined by a print side and an adhesive side for subsequent application to an article. The method includes providing a cutting device including a heated cutting element. The web of linerless tape is directed to the heated cutting element such that the print side is proximate the heated cutting element. Finally, the web of linerless tape is contacted by the heated cutting element to sever a segment from a remainder of the web. In one preferred embodiment, the web of linerless tape has a thickness of less than about 90 microns and the heated cutting element is a ribbon wire heated to a temperature in the range of 260–371° C. prior to contacting the web.

DESCRIPTION OF THE PREFERRED EMBODIMENTS

Figure 1:
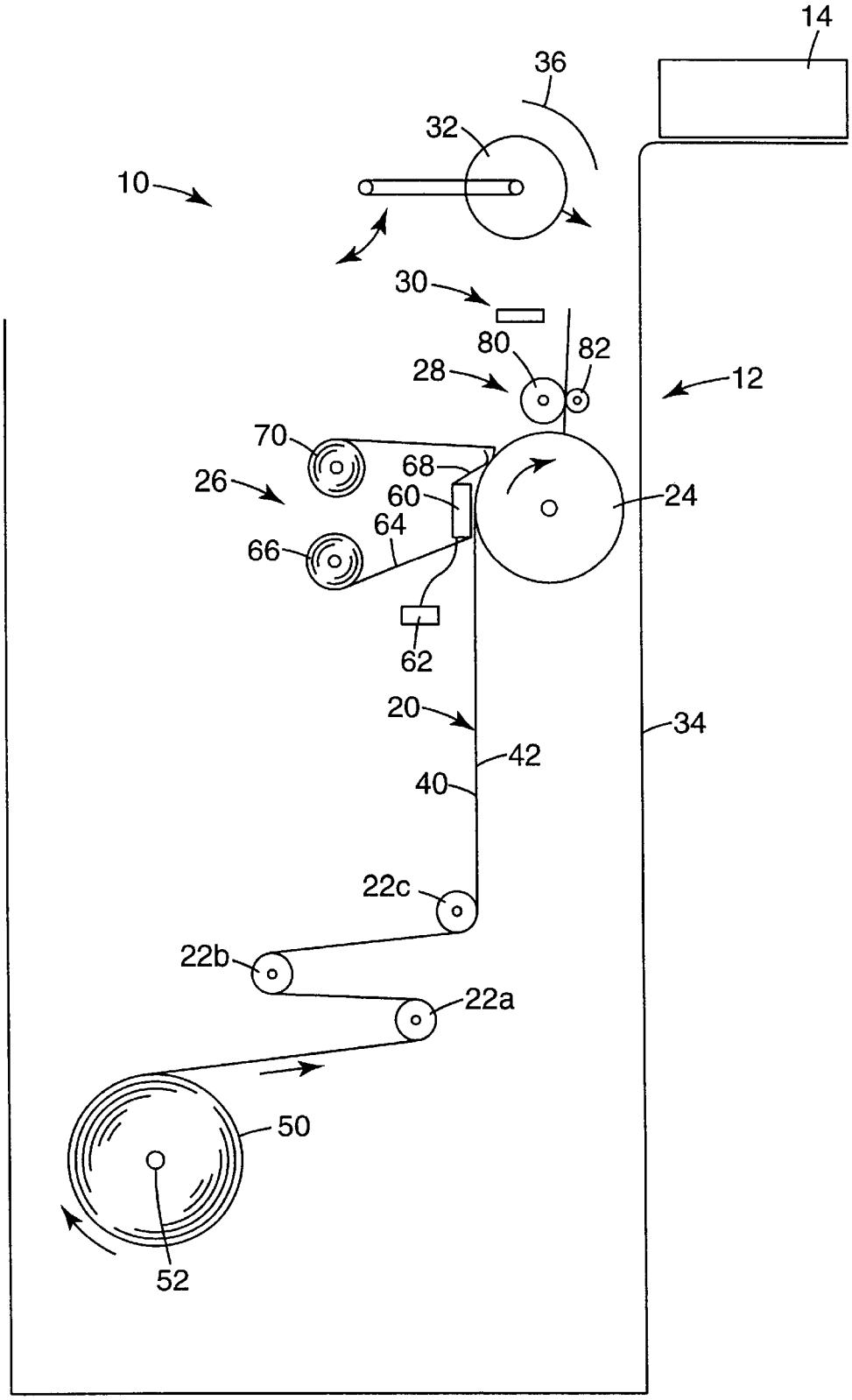
FIG. 1 is a schematic, side view of a printing device incorporating a stripping apparatus in accordance with the present invention.

A printing device 10 incorporating a handling system 12 in accordance with one preferred embodiment of the present invention is illustrated in FIG. 1. As a point of reference, the printing device 10 is, as is known in the art, employed to print onto a label tape to define a label segment, and apply subsequently cut label segments to an article 14 of interest, such as a box. It will be understood that the article 14 can assume a wide variety of forms, including containers, packages, finished good articles, flats, etc. The term "label tape" is, as described in greater detail below, in general reference to a substrate that is linerless; that can be supplied in a roll (such as a self-wound roll); and that is not pre-cut. Because, in roll form, the label tape typically does not include printing and is supplied as a continuous web, the terms "web of linerless tape" or simply "tape" can be used interchangeably with the term "label tape". The term "label segment" is used to mean a portion of a continuous web of linerless label tape that can convey information (such as by printing) and that can be affixed to a surface. Label segments include the tape after it is printed (if it is to be printed), both before and after it is severed from a remainder of the continuous web.

The handling system 12 is useful with a variety of differently configured printing devices. In this regard, label-printing devices are generally configured as either a "loose loop" device or a "next label segment out" device. The printing device 10 illustrated in FIG. 1 conforms with the next label segment out protocol, whereby after a label segment is printed, it is then immediately applied to the surface in question. One example of a next label segment out device is sold under the tradename "Model 2140 Printer/Applicator Two Panel, Box Labeler" by Label-Aire Inc., of Fullerton, Calif. However, the handling system 12 is also useful with a loose loop-type design in which a given label segment is printed, but not immediately applied to the article 14. Instead, following printing, the label segment is wound through a tape path defined, for example, by an accumulator or festoon, because it will be applied to an article that is sequentially located behind several as-of-yet unlabelled articles at the time immediately following printing. One or more previously printed label segments must be applied after the given label segment is printed and before the given label segment is applied. One example of an available loose loop device is sold under the tradename "3M-Matic Print/Apply Case Labeling System CA2000" by Minnesota Mining and Manufacturing Company (3M) of St. Paul, Minn.

In general terms, the printing device 10 includes a web of linerless tape 20, guide rollers 22*a*–22*c*, a platen roller 24, a print apparatus 26, a stripping apparatus 28, a cutting device (or cutter) 30, an applicator 32, and a housing 34 maintaining the components 20–32. The components 20–32 are described in greater detail below. In general terms, however, the web of linerless tape 20 is initially provided as a roll otherwise supported by the housing 34. The guide rollers 22*a*–22*c* direct the web of linerless tape 20 to the platen roller 24, which in turn guides the web of linerless tape 20 past the print apparatus 26 for printing thereon. The stripping apparatus 28 receives the web of linerless tape 20 from the platen roller 24 and directs it to the cutting device 30. Following a cutting operation, the applicator 32 (such as a vacuum wheel) applies a label segment 36 to the box 14.

The web of linerless tape 20 can be a single-coated pressure sensitive adhesive tape or media having a multiple layer construction including a backing layer. The backing layer can be, for example, a single or multiple layer plastic-film backing. Suitable plastic film backings include polypropylene, polyethylene, copolymers of polypropylene and polyethylene, polyvinyl chloride (PVC), polyesters, and vinyl acetates. The polypropylene can include monoaxially-oriented polypropylene (MOPP), biaxially-oriented polypropylene (BOPP), or sequentially or simultaneously biaxially-oriented polypropylene (SBOPP). The backing material can be compostible, degradable, colored, printed, and can be of different surface textures or embossed. Pressure sensitive adhesive is preferably coated onto one side of the backing and a release coating (such as low adhesion back size (LAB) layer) is optionally coated on the opposite side to allow the tape to unwind from itself when wound in a roll. Alternatively, the linerless tape 20 can have a limited tackiness.

As will be understood by one of ordinary skill in the art, the exact construction of the web of linerless tape 20 can assume a wide variety of forms. In a preferred embodiment, however, the web of linerless tape 20 is highly thin, having a thickness of less than approximately 90 microns (3.5 mils). One example of an acceptable linerless tape is sold under the tradename "3340 Scotch® Printable Tape" by 3M. Notably, however, the printing device 10, and in particular, the handling system 12, is equally useful with thicker linerless tape.

With this description in mind, the web of linerless tape 20 is defined by a print side 40 and an adhesive side 42. The print side 40 is configured to receive indicia from the print apparatus 26, whereas the adhesive side 42 preferably carries an adhesive properly configured to secure a segment (e.g., the label segment 36) of the linerless tape 20 to a surface, such as a surface of the box 14, although the adhesive side 42 alternatively is of limited tackiness. Where employed, many types of adhesives can be used, and the adhesive is preferably a pressure sensitive adhesive. Pressure sensitive adhesives are normally tacky at room temperature and can be adhered to a surface by application of, at most, light finger pressure. Alternatively, an activatable or other type of adhesive can be used, as is known in the art.

The web of linerless tape 20 is preferably provided as a roll 50 that is rotatably maintained within the housing 34 by a support 52 (shown generally in FIG. 1). A layer or strip of the web 20 is "pulled" from the roll 50 and transitioned through a tape path defined by the guide rollers 22*a*–22*c*. The guide rollers 22*a*–22*c* are of a type(s) known in the art, and are positioned to contact or engage the linerless tape 20. In general terms, the guide rollers 22*a*–22*c* are provided to effectuate a tension in the linerless tape 20 upstream of the platen roller 24 and the print apparatus 26. Thus, the guide rollers 22*a*–22*c* can assume a wide variety of forms and locations, and can contact either the print side 40 or the adhesive side 42. In one preferred embodiment, the guide roller 22*a* is a pre-stripper roller and the guide roller 22*b* is an accumulator roller. The pre-stripper roller 22*a* is optionally a driven roller controlled by a position of the accumulator roller 22*b*. With this one preferred configuration, the rollers 22*a*, 22*b* work in concert to eliminate "chatter" or "shockiness" in the linerless tape 20 at the print apparatus 26*c* by achieving a consistent "pull" off of the roll 50. Alternatively, the rollers 22*a*–22*c* need not include a pre-stripper roller and/or an accumulator roller. Even further, while three of the guide rollers 22 are illustrated in FIG. 1, any other number, either greater or lesser, is equally acceptable. Further, additional guide components, such as plates, arms, festoons, etc., can also be included to effectuate desired positioning and/or tension in the linerless tape 20 upstream of the platen roller 24.

The platen roller 24 is also of a type known in the art and is rotatably driven (clockwise in the orientation of FIG. 1). As is known in the art, the platen roller 24 preferably has a diameter in the range of 1.3–1.6 cm (0.5–0.625 inch). As described in greater detail below, the platen roller 24 is positioned to guide the linerless tape 20 past the print apparatus 26 for printing on the print side 40 thereof. Thus, the platen roller 24 is configured to receive the adhesive side 42 of the linerless tape 20. In the preferred embodiment of FIG. 1, the platen roller 24 is positioned directly beneath a print head 60 portion of the print apparatus 26, such that the platen roller 24 supports the linerless tape 20 during a printing operation by the print head 60. Alternatively, however, the platen roller 24 is positioned slightly upstream or downstream of the print head 60. In this regard, the roller 24 may be something other than a "platen" roller, as that term is commonly used. For purposes of this specification, "platen roller" is a roller most closely positioned to the print head 60. Thus, the platen roller 24 is associated with the print head 60.

The print apparatus 26 is of a type known in the art, and preferably includes the print head 60 electrically connected to a controller 62. Based on input, the controller 62 controls the print head 60 to print desired indicia (e.g., alphanumeric, bar codes, images, logos, other printed information, etc.) on the print side 40 of the linerless tape 20. In one preferred embodiment, the print apparatus 26 is a thermal transfer printer, such as model PE42 from Datamax Corporation (Orlando, Fla.), or a similar printer or print engine with or without modification and includes a ribbon 64, a supply roller 66, a ribbon guide 68, and a take-up roller 70. The ribbon 64 extends from the supply roller 66 about the print head 60 and the ribbon guide 68, and to the take-up roller 70. Thus, the ribbon 64 is directed between the print head 60 and the linerless tape 20 for effectuating printing by the print head 60 on the linerless tape 20. As described in greater detail below, the preferred ribbon guide 68 maintains contact between the ribbon 64 and the linerless tape 20 downstream of the print head 60, such that the ribbon 64 partially wraps about the platen roller 24. Alternatively, the print apparatus can assume other forms known in the art. For example, the print apparatus 26 can be an ink jet printer, such that the print head 60 is an ink jet print head. Alternatively, direct thermal, impact, or other print systems are equally applicable.

The stripping apparatus 28 is positioned adjacent the platen roller 24 downstream of the print head 60. In one preferred embodiment, the stripping apparatus 28 includes a first, backside roller 80 and a second, adhesive side roller 82. As described in greater detail below, the first and second rollers 80, 82, operate in tandem to pull or "strip" the linerless tape 20 from the platen roller 24. In this regard, the first roller 80 is positioned to receive and engage the print side 40 of the linerless tape 20; whereas the second roller 82 is positioned to receive and contact the adhesive side 42. The first roller 80 is preferably positioned in close proximity to the platen roller 24 to minimize the length of the tape path from the platen roller 24 to the stripping apparatus 28.

Figure 2:
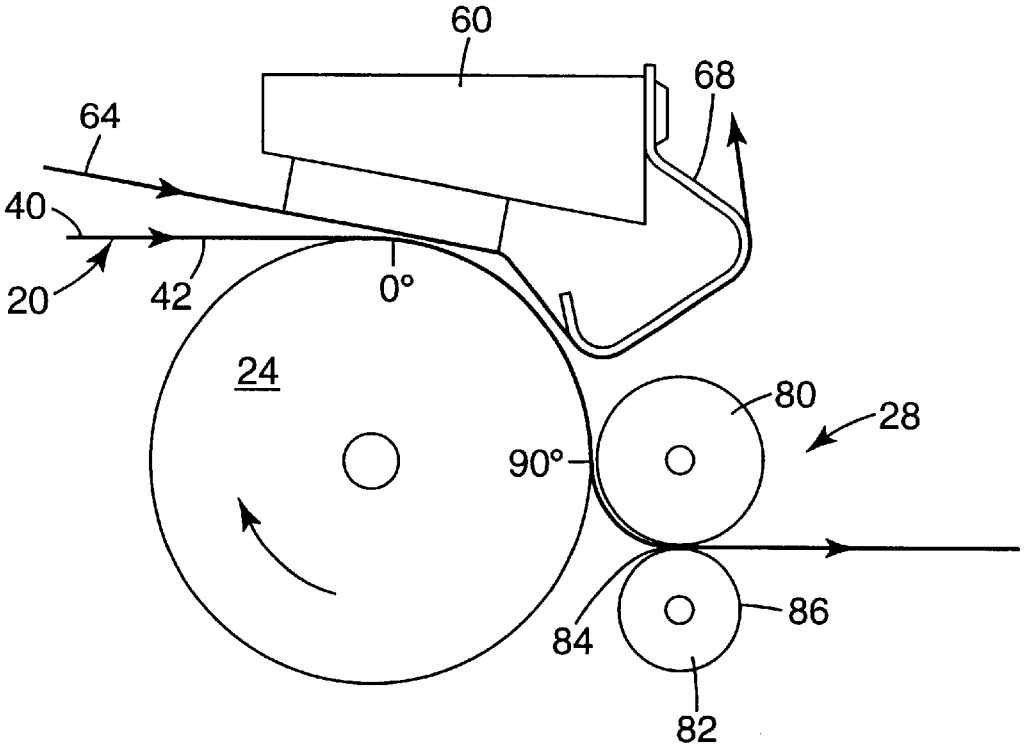
FIG. 2 is an enlarged, schematic, side view of a stripping apparatus portion of the device of FIG. 1.

The relationship and operation of the stripping apparatus 28 relative to the platen roller 24 is shown more clearly by the enlarged, side view of FIG. 2. As a point of reference, for purposes of clarification, orientation of the various components illustrated in FIG. 2 has been rotated approximately 90 degrees relative to the orientation of FIG. 1. Once again, the print head 60 is associated with the platen roller 24 for printing indicia on the print side 40 of the linerless tape 20. In the view of FIG. 2, the point of interaction between the print head 60 and the linerless tape 20 has been designated as "0°" relative to the platen roller 24. With this starting point in mind, the stripping apparatus 28 is positioned to allow the linerless tape 20 to partially wrap about the platen roller 24 downstream of the print head 60 before pulling or stripping the linerless tape 20 off of the platen roller 24. This is in direct contrast to other linerless label tape handling systems whereby every effort is made to remove the tape from the platen roller 24 immediately following printing. Instead, the present invention recognizes the strong affinity of the adhesive side 42 to adhere to the platen roller 24, especially with recently available, highly thin tape (e.g., less than 90 microns). Thus, by not requiring immediate stripping from the platen roller 24 following printing, the handling system 12 of the present invention allows the linerless tape 20 to wrap to a position relative to the platen roller 24 at which dislodgment or stripping can more easily occur, and assists in limiting back slipping of the linerless tape 20 relative to the platen roller 24 during rotation thereof.

In one preferred embodiment, the stripping apparatus 28 is positioned to define a tape path relative to the platen roller 24 whereby the linerless tape 20 wraps along a wrap angle of 90° downstream of the print head 60. This one preferred position is illustrated at "90°" in FIG. 2. Alternatively, other wrap angles are also acceptable, either greater or lesser. In a preferred embodiment, a wrap angle defined by the stripping apparatus 28 relative to the platen roller 24 is greater than 60°. It is recognized, however, that a wrap angle of greater than 90° may result in more waste of the linerless tape 20. In particular, the web extension between the print head 60 and the end of the linerless tape 20 at the cutter 30 or the applicator 32 or another location is referred to herein as the leader. At the end of a print job, a leader of linerless tape remains. If this leader is not already printed with indicia designated for the next label segment because it is not known in advance what such information will be, then this leader is unprinted and can be wasted tape, i.e., unused for the next label segment. Thus, it is advantageous to minimize the leader length to minimize waste. Minimizing the wrap angle around the platen roller 24 reduces the leader length. However, a wrap angle of at least approximately 90° is advantageous for avoiding backslip. Therefore, a wrap angle of about 90° is optimal for platen rollers of typical diameter (e.g., 1.3–1.6 cm (0.5–0.625 inch)). The wrap angle could be less for rollers of greater diameter, although this is not preferred.

To engage the linerless tape 20, the first and second rollers 80, 82 form a nip Unidentified generally at 84) therebetween. In this regard, the first roller 80 is positioned relative to the platen roller 24 such that the linerless tape 20, and in particular, the print side 40, wraps about a portion of the first roller 80 from the platen roller 24 to the nip 84. In a preferred embodiment, a wrap angle of approximately 90° is established along the first roller 80. This preferred wrap angle promotes a positive pull or tension on the linerless tape 20. Alternatively, a different wrap angle, preferably greater than about 60°, can be established about the first roller 80.

The first and second rollers 80, 82 are both rotatably driven to establish and maintain the desired tension or positive pull on the linerless tape 20 as it extends from the platen roller 24. In particular, the first roller 80 is preferably driven at a slightly greater surface speed than the platen roller 24, preferably at least 101%–102% of the surface speed of the platen roller 24. Further, the second roller 82 is preferably driven at a slightly greater surface speed than the first roller 80, more preferably at least 101%–102% of the surface speed of the first roller 80. This preferred operational characteristic ensures a positive pull or tension on the linerless tape 20 that prevents the linerless tape 20 from "slipping back" and wrapping about the platen roller 24 beyond the desired wrap position previously described. In one preferred embodiment, the first roller 80 is geared to, or otherwise driven off of, the platen roller 24; whereas the second roller 82 is geared to, or otherwise driven off of, the first roller 80. With this one preferred embodiment, because the first roller 80 preferably has a diameter smaller than that of the platen roller 24, where an appropriate gear ratio is employed, the first roller 80 will rotate at an elevated surface speed as compared to the platen roller 24. Similarly, because the second roller 82 preferably has a diameter smaller than that of the first roller 80, where an appropriate gear ratio is employed, the second roller 82 will rotate at an elevated surface speed as compared to the first roller. Alternatively, a wide variety of other drive configurations are equally acceptable.

The first roller 80 preferably provides a high traction surface, and is comprised of an acceptable material such as silicone rubber. With this construction, the first roller 80 maintains contact with the print side 40 the linerless tape 20, but does not alter or otherwise deteriorate indicia printed thereon. In one preferred embodiment, the first roller 80 defines an outer diameter of approximately 0.6 cm (0.25 inch), although other dimensions are equally acceptable.

Figure 3:
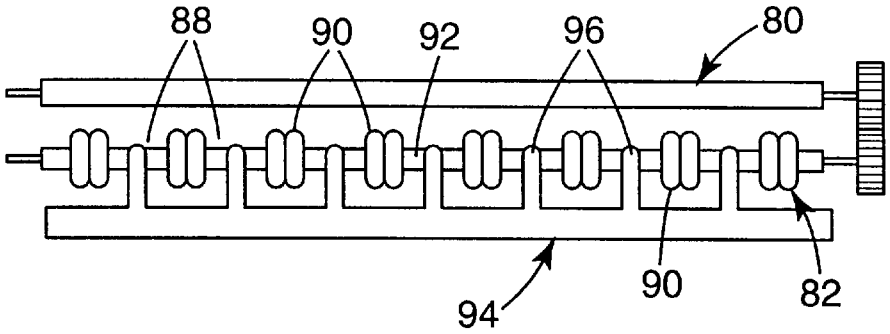
FIG. 3 is a front, simplified view of the stripping apparatus of FIG. 2.

With additional reference to FIG. 3, the second roller 82, as previously described, is positioned to receive and contact the adhesive side 42 of the linerless tape 20. In this regard, the second roller 82 is preferably configured to minimize adhesion with the adhesive side 42. In one preferred embodiment, the second roller 82 defines a contact surface 86 (identified generally in FIG. 2) forming a plurality of grooves 88 (shown in FIG. 3). Effectively, the plurality of grooves 88 minimize the overall area of the contact surface 86, and thus, the area of interface with the linerless tape 20. Each of the plurality of grooves 88 preferably has a longitudinal width in the range of 0.32–0.6 cm (0.125–0.25 inch), although other dimensions can also be employed.

To effectuate this preferred grooved configuration, in one preferred embodiment, the second roller 82 is comprised of a plurality of O-rings 90 mounted over a central shaft 92. The O-rings 90 combine to define the contact surface 86, with a spacing between the O-rings 90 defining the grooves 88. To further minimize adhesion with the adhesive side 42, the O-rings 90 are preferably made from a relatively non-stick material, such as silicone rubber, other rubbers, PTFE, plasma, or other similarly non-stick materials. Further, the O-rings 90 are preferably not rigidly secure to the central shaft 92, but instead can "slip" when subjected to an elevated tangential force. Thus, if the second roller 82 is driven too fast and/or tension on the linerless tape 20 is too high, the O-rings 90 will "slip" over the central shaft 92, thereby preventing damage to the linerless tape 20. While the preferred embodiment of the second roller 82 includes the O-rings 90, a wide variety of other configurations can be employed to form the plurality of grooves 88. Even further, where an appropriate, non-stick material is utilized, the grooves 88 can also be eliminated.

As illustrated in FIG. 2, the outer diameter of the second roller 82 is preferably less than that of the first roller 80. Smaller diameters are preferred for the second roller 82 so as to minimize potential adhesion to the adhesive side 42. In a preferred embodiment, the outer diameter of the second roller 82 is in the range of approximately 0.2–0.6 cm (0.09–0.25 inch), most preferably 0.32 cm (0.125 inch). In this regard, a diameter of less than about 0.2 cm (0.09 inch) for the second roller 82 is less preferred as the second roller 82 could deform due to insufficient rigidity, leading to poor pull or tension at the stripping apparatus 28.

To further prevent undesirable adhesion of the linerless tape 20 to the second roller 32 (and thus, wrap-around the second roller 82), in one preferred embodiment, the handling system 12 further includes a guard 94 associated with the second roller 82, as most clearly shown in FIG. 3. For purposes of clarification, FIG. 3 depicts the first roller 80 as being retracted from the second roller 82. The guard 94 forms a plurality of fingers 96 each sized to extend within a respective one of the plurality of grooves 88. The guard 94, and in particular the plurality of fingers 96, are preferably made from or coated with a non-stick surface such as silicone or plasma. With this configuration, in the event that the linerless tape 20 undesirably adheres to the second roller 82 and begins to wrap therearound, the linerless tape 20 will contact the plurality of fingers 96 which serve to guide or strip the linerless tape 20 off of the second roller 82. Alternatively, other guard configurations are equally acceptable. Even further, where second roller 82 wrap-around is of minimal concern, the guard 94 can be eliminated entirely.

Returning to FIG. 2, by purposefully allowing a partial wrap of the linerless tape 20 about the platen roller 24, an additional printing advantage can be realized. More particularly, where a conventional thermal transfer-type print apparatus 26 (FIG. 1) is employed, the ribbon 64 can desirably remain in contact with the print side 40 of the linerless tape 20 for a short time following printing thereon as the linerless tape 20 is wrapped about the platen roller 24.

As shown in FIG. 2, the ribbon guide 68 projects downstream of the print head 60 and forces the ribbon 64 through a tape path by which the ribbon 64 wraps about the platen roller 24 to a wrap angle of at least 30°, more preferably approximately 60°. The ribbon guide 68 can assume a wide variety of forms to effectuate the desired tape path other than that shown in FIG. 2, and is preferably formed from a material acceptable for contact with the ribbon 64, such as stainless steel Notably, the tape path defined by the ribbon guide 68 must be such that the ribbon 64 is removed from the linerless tape 20 upstream of the stripping apparatus 28. By allowing the ribbon 64 to remain in contact with the print side 40 of the linerless tape 20 following printing for a short time period (the dwell time), ink otherwise disposed onto the print side 40 will more sufficiently solidify before separation of the ribbon 64 therefrom. This generally improves the edge sharpness and resolution of indicia printed onto the linerless tape 20 when conventional thermal transfer printing is used as the printing method. Alternatively, other printing techniques preferably separate the ribbon 64 from the linerless tape 20 immediately following printing (e.g. near edge thermal transfer printing) or do not make use of a ribbon (e.g., ink jet printing) such that the ribbon guide 68 can be eliminated entirely.

Returning to FIGS. 1 and 2, prior to use, the web of linerless tape 20 is installed within the housing 34 and extended through the desired tape path defined by the handling system 12. In particular, a leading end of the linerless tape 20 is extended from the guide rollers 22 to the print area defined by the print head 60. The linerless tape 20 is then wrapped about a portion of the platen roller 24 and extended to the nip 84 formed by the first and second rollers 80, 82. In this regard, the second roller 82 is preferably selectively retractable relative to the first roller 80 (via a coupling device including, for example, a spring) such that the linerless tape 20 can easily be positioned between the first and second rollers 80, 82. During a printing operation, the platen roller 24 is rotated to drive the inerless tape 20 past the print head 60 for printing of indicia on the print side 40 thereof. The first and second rollers 80, 82 are similarly rotatably driven and operate in tandem to pull or strip the linerless tape 20 from the platen roller 24, preferably at a wrap angle of 90°, and tension the linerless tape 20 to prevent back slipping and/or additional wrap-around on the platen roller 24. Following printing and transfer through the stripping apparatus 28, the label segment 36 is delivered to the cutter 30 where the label segment 36 is severed from a remainder of the web 20.

Figure 4A:
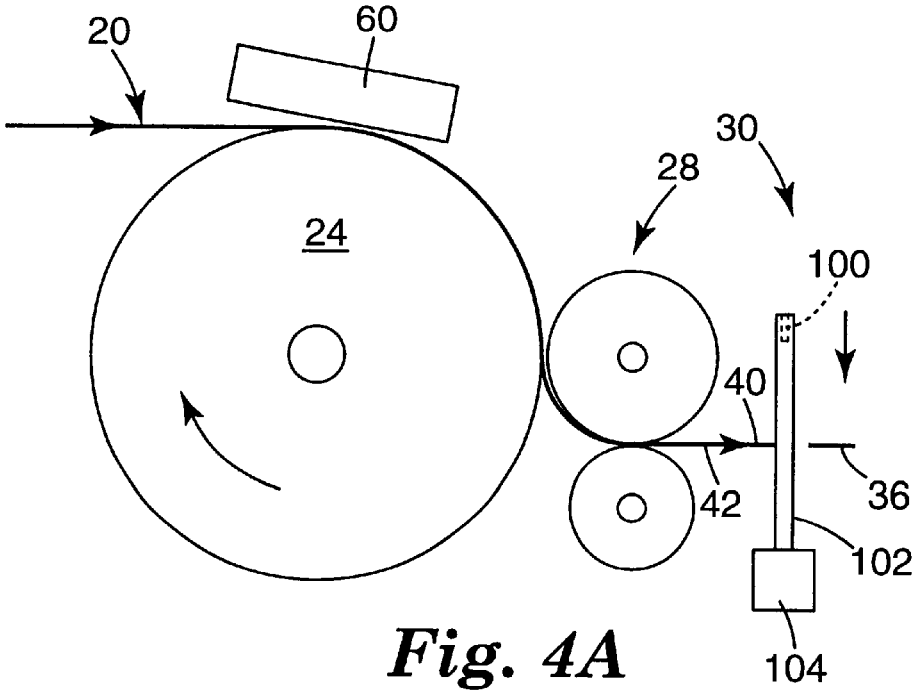
FIG. 4A is an enlarged, schematic, side view of a cutter portion of the device of FIG. 1.
Figure 4B:
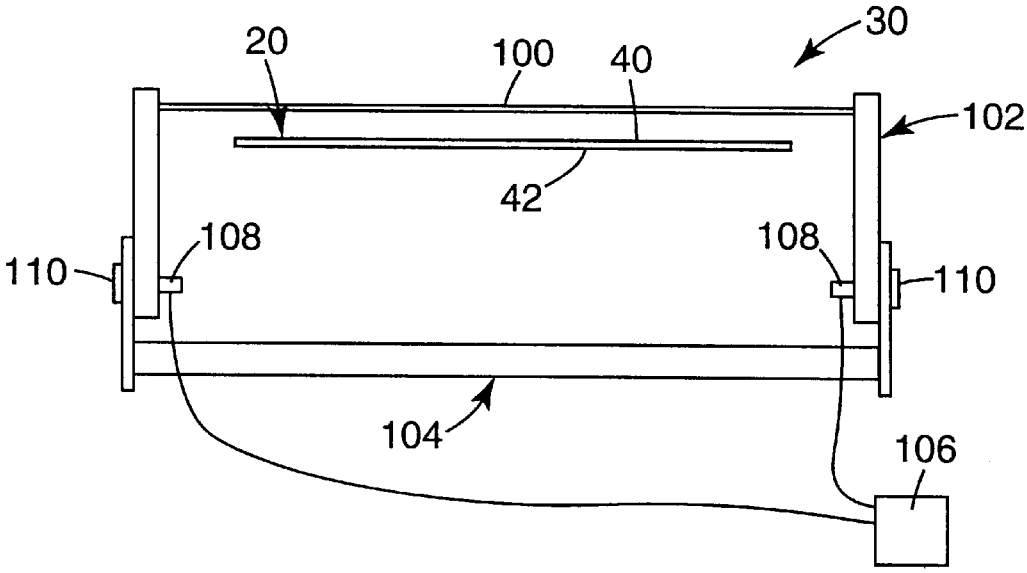
FIG. 4B is a simplified, front view of the cutter of FIG. 4A.

Unlike prior linerless label tape cutting devices in which a mechanical cutter (e.g., die, rotary, or scissors) is employed, the cutter 30 of the present invention is preferably a heated cutting element. The preferred configuration of the cutter 30 is best described with reference to FIGS. 4A and 4B. As shown in FIG. 4B, the cutter 30 preferably includes a heated wire 100, a wire support frame 102, a base 104 and a power source 106 (shown schematically in FIG. 4B). The heated wire 100 is maintained by the support frame 102, which, in turn, is moveably mounted to the base 104. The base 104 is mounted within the housing 34 (FIG. 1). Finally, the heated wire 100 is electrically connected to the power source 106, for example via the wire support frame 102. With this general configuration in mind, the heated wire 100 is energized, via the power source 106, to a predetermined temperature, and then placed into contact with the linerless tape 20, for example by movement of the support frame 102 relative to the base 104, to effectuate severing of the label segment 36 as described in greater detail below. As a point of reference, FIG. 4A depicts the stripping apparatus 28 as supplying the web of linerless tape 20 to the cutter 30. This is but one example of an acceptable material supply device. In other words, the cutter 30 is in no way limited to use with the stripping apparatus 28. Any other apparatus can be used to supply the linerless tape 20 to the cutter 30; in fact, the linerless tape 20 can be supplied directly from the platen roller 24.

The heated wire 100 is preferably a ribbon wire having a relatively high height:width ratio. In a preferred embodiment, the heated wire 100 has a height:width ratio greater than 20:1, more preferably greater than 25:1. This preferred configuration creates a relatively thin surface (i.e., the width) for precisely contacting the linerless tape 20, and a relatively large mass (i.e., the increased height relative to a circular wire) for maintaining or "holding" the heated wire 100 at a desired temperature.

The heated wire 100 is preferably a Nichrome ribbon wire having a width of approximately 0.08 mm (0.003 inch) and a height of approximately 2 mm (0.08 inch). Such ribbon wires are available as bare resistance wire from, for example, Midwest Thermo Equipment, Inc. (Medina, Minn.). Alternatively, other relatively rigid, conductive materials, such as nickel, are equally acceptable, as are other dimensional characteristics. Notably, however, reducing the thickness or width of the heated wire 100 below about 0.08 mm (0.003 inch) may increase the cost of fabrication and reduce a useful life of the heated wire 100. Further, at thicknesses (or widths) less than about 0.08 mm (0.003 inch), the heated wire 100 effectively forms a knife-edge, raising safety concerns. By preferably providing the heated wire 100 as a ribbon wire (e.g., with a substantial height), the heated wire 100 effectively serves as a heat sink, maintaining a desired temperature. Thus, the preferred construction of the ribbon wire 100 exhibits good conductivity, surface area and thermal mass on a relatively low-cost basis.

The above-described preferred construction of the heated wire 100 allows the heated wire 100 to reach temperatures in the range of 260°–371° C. (500°–700° F.) in approximately 3 seconds upon application of approximately 3 amps at 4 volts, and can cool to approximately room temperature in approximately 1 second following cessation of the energy supply. As described below, this temperature range is optimal for severing the linerless tape 20.

While the cutter 30 has been preferably described as utilizing a heated ribbon wire, other heated elements are acceptable. For example, a circular wire, a knife blade, etc., can be used in place of the ribbon wire 100.

The support frame 102 is preferably formed of an electrically conductive material, such as steel, and maintains the heated wire 100 in tension. In this regard, connectors 108 electrically connect the power source 106 to opposite sides of the support frame 102 to deliver power to the heated wire 100. Alternatively, however, the cutter 30 can be configured such that the power source 106 is electrically connected to the heated wire 100 directly, such that the support frame 102 need not be formed of an electrically conductive material. As shown in FIG. 4B, the support frame 102 is secured to, and only contacts, opposing ends of the heated wire 100. That is to say, the heated wire 100 is maintained in slight tension by the support frame 102, but is otherwise unsupported. During a cutting operation, the heated wire 100 does not contact any bodies (e.g., such as a drum, plate, etc.) other than the linerless tape 20 (i.e., the heated wire 100 is unsupported), and thus will readily maintain a desired temperature.

The support frame 102 is mounted to the base 104 such that the support frame 102 is moveable, in one preferred embodiment pivotable, relative to the base 104. For example, pins 110 can be used to pivotably couple the support frame 102 to the base 104. With this configuration, the support frame 102 can be controlled, manually, mechanically or electrically, to selectively maneuver the heated wire 100 into contact with the linerless tape 20. Notably, other mounting techniques can be employed to render the heated wire 100 selectively moveable relative to the linerless tape 20.

The base 104 is configured to be mountable within the housing 34, and can assume a wide variety of forms. In a preferred embodiment, however, the base 104 is configured to remain stationary during a cutting operation.

Similarly, the power source 106 can assume a wide variety of forms, and is preferably electrically connected to a control device (not shown) that control activation of the power source 106. With the one preferred configuration of the heated wire 100, the power source 106 is configured to selectively deliver in upwards of 8 volts.

With specific reference to FIG. 4A, the cutter 30 is preferably mounted downstream of a supply device (for example the stripping apparatus 28) such that the heated wire 100 is proximate (or above relative to the orientation of FIG. 4A) the print side 40 of the linerless tape 20. With this orientation, the heated wire 100 will initially contact the print side 40 (as opposed to the adhesive side 42) during a cutting operation.

Prior to use, the heated wire 100 is retracted relative to the linerless tape 20 and is heated to a temperature in the range of 150–540° C. (300–1000° F.), more preferably in the range of 260–371° C. (500–700° F.), such as by the application of 4 volts from the power source 106. In a preferred embodiment, the heated wire 100 achieves this desired temperature range in 3 or less seconds. As the linerless tape 20 is delivered from a supply device (such as the stripping apparatus 28), the heated wire 100 is directed into contact with the print side 40. For example, a controller (not shown) is provided that controls movement of the support frame 102. Based upon a desired length of the label segment 36 and a speed of the linerless tape 20 being delivered to the cutter 30, the controller signals the support frame 102 to bring the heated wire 100 into contact with the linerless tape 20, and in particular the print side 40. As will be understood by one of ordinary skill, a variety of other control devices/configurations can be employed to cause the heated wire 100 to move into contact with the linerless tape 20.

As the heated wire 100 contacts the linerless tape 20, the elevated temperature of the heated wire 100 causes the linerless tape 20 to melt and soften. In a preferred embodiment, the linerless tape 20 is tensioned downstream of the cutter 30. For example, as shown in FIG. 4A, the linerless tape 20 is engaged by the applicator 32 (e.g., a vacuum wheel) that in turn applies the subsequently cut label segment 36 to the box 14. Thus, prior to cutting, the label segment 36 is attached to a remainder of the web of linerless tape 20, and is engaged by the applicator 32 downstream of the cutter 30 such that the applicator 32 imparts a preferred tension to the linerless tape 20. This minor tension causes the label segment 36 to sever from a remainder of the web 20 along the melt/softening line created by the heated wire 100.

This preferred cutting method produces a highly uniform, straight cut. Further, by limiting the operational temperature of the heated wire 100 to the range of 260°–371° C. (500°–700° F.) and by initially contacting the print side 40 (as opposed to the preferably adhesive-carrying, adhesive side 42), little if any off gassing (or burning) of the linerless tape 20 will occur. That is to say, with a preferred polypropylene-based, highly thin linerless tape, a temperature of less than about 371° C. (700° F.) will not decompose the linerless tape 20, and the plastic material will not overly melt and adhere to the heated wire 100 surface (where it could subsequently burn). Notably, off gassing is undesirable, as it can lead to unpleasant odors and potentially toxic fumes in the work environment, and adversely affects the desirably uniform nature of the cut. To this end, it has been Found that greatly elevated temperatures, in excess of, for example, approximately 538° C. (1000° F.) applied to a linerless tape having a polypropylene backing will result in decomposition.

Following successful severing of the label segment 36 from a remainder of the web of linerless tape 20, the heated wire 100 is retracted, and the label segment 36 applied to the box 14 (FIG. 1) as previously described. From time-to-time, it may be necessary to clean accumulated material from a surface of the heated wire 100. To this end, by simply increasing the voltage supplied to the heated wire 100, the temperature of the heated wire 100 can be elevated to a level at which the material bums off. For example, with the one preferred construction of the heated wire 100, supplying a voltage from the power source 106 of approximately 8 volts for approximately 4 seconds raises the temperature of the heated wire 100 to approximately 871° C. (1600° F.), causing undesired material to burn off. Effectively, then, the cutter 30 of the present invention is self-cleaning.

The linerless tape handling system and method of the present invention, as applied with label printing devices, provides a marked improvement over previous designs. Implementation of a stripping apparatus, including two rollers forming a nip therebetween, to pull linerless tape from the platen roller downstream of the print head allows the printing device to consistently process highly thin (e.g., less than 90 microns), plastic-based, linerless label tape. Further, by allowing the linerless tape to partially wrap about the platen roller following printing, a preferred positioning of the stripping apparatus promotes enhanced printing, as well as uniform handling. In addition, use of a heated ribbon wire cutter to sever a label segment from the web of linerless tape facilitates straight cuts with minimal cutter downtime for cleaning.

Although the present invention has been described with reference to preferred embodiments, workers skilled in the art will recognize that changes can be made in form and detail without departing from the spirit and scope of the present invention. For example, the preferred handling and cutting devices have been described as being used in combination with a next label segment out printing device. Alternative, the handling system can be used independently, and with a different printer configuration, such as a "loose loop" design. Similarly, the heated ribbon wire cutter can achieve highly proficient results without use of the preferred handling system.

What is claimed is:

1. A method of severing a label segment from a web of linerless tape within a printing device for subsequent application to an article, the web of linerless tape being defined by a print side and an adhesive side, the method comprising:

providing a cutting device including a heated cutting element;

directing the web of linerless tape to the heated cutting element with a supply device such that the print side is proximate the heated cutting element;

contacting the web of linerless tape with the heated cutting element to sever the label segment from the remainder of the web as part of a cutting operation; and raising the temperature of the heated cutting element to at least a temperature of 1600° Fahrenheit to clean the heated cutting element following the cutting operation.

* * * * *

UNITED STATES PATENT AND TRADEMARK OFFICE

CERTIFICATE OF CORRECTION

PATENT NO. : 6,652,172 B2
DATED : November 25, 2003
INVENTOR(S) : Wood, Thomas L.

It is certified that error appears in the above-identified patent and that said Letters Patent is hereby corrected as shown below:

Title page,
Item [56], References Cited, U.S. PATENT DOCUMENTS, insert
-- 4,909,885 03/1990 Swenson -- following "4,889,581…"; "11/1993" should be -- 11/1996 --; "II" should be -- III --.
FOREIGN PATENT DOCUMENTS, "0 096 423 A1 1/1994" should be -- 0 096 841 A1 12/1983 --.

Column 9,
Line 18, "Unidentified" should be -- (identified --.
Line 59, insert -- of -- following "40".

Column 10,
Line 19, "secure" should be -- secured --.
Line 42, "32" should be -- 82 --.

Column 11,
Line 38, "inerless" should be -- linerless --.

Column 14,
Line 16, "bums" should be -- burns --.
Line 44, "Alternative" should be -- Alternatively --.

Signed and Sealed this

Sixteenth Day of March, 2004

JON W. DUDAS
*Acting Director of the United States Patent and Trademark Office*